United States Patent [19]

Good

[11] Patent Number: 4,550,839

[45] Date of Patent: Nov. 5, 1985

[54] DISPLAY SYSTEM

[75] Inventor: Jack E. Good, Salt Lake County, Utah

[73] Assignees: Grant Larsen; Marian Larsen, both of Salt Lake City, Utah ; a part interest to each

[21] Appl. No.: 426,123

[22] Filed: Sep. 28, 1982

[51] Int. Cl.[4] ..... A47F 5/00

[52] U.S. Cl. ..... 211/189; 248/220.3

[58] Field of Search ..... 211/189, 163, 198, 196, 211/205, 199; 248/220.3, 220.4, 221.1, 221.2; 16/260, 261, 262, 263

[56] References Cited

U.S. PATENT DOCUMENTS

| | | | |
|---|---|---|---|
| 1,620,737 | 3/1927 | Peterson | 211/43 X |
| 2,919,813 | 1/1960 | Clark | 211/65 |
| 3,091,423 | 5/1963 | Butterworth | 248/221.2 |
| 3,139,185 | 6/1964 | Wentz | 211/14 |
| 3,231,097 | 1/1966 | Hodson | 248/221.1 |
| 3,292,797 | 12/1966 | Berk | 211/163 |
| 3,484,069 | 12/1969 | Larson | 248/221.1 |
| 3,692,617 | 9/1972 | Marks et al. | 211/205 X |
| 3,931,894 | 1/1976 | Murphy | 211/189 |
| 3,949,445 | 4/1976 | Stevens | 16/262 |
| 4,040,520 | 8/1977 | Joaquin | 211/163 X |

*Primary Examiner*—Robert W. Gibson, Jr.
*Attorney, Agent, or Firm*—M. Reid Russell

[57] ABSTRACT

An invention in triangular shaped display panels arranged for connection in edge to edge configuration in a freestanding structure with connector items for maintaining the panel edges together and including hardware items and support arrangements for display of merchandise thereon, the erected structure capable of being adapted also for use as a holiday tree or item of home decor.

14 Claims, 20 Drawing Figures

DISPLAY SYSTEM

BACKGROUND OF THE INVENTION

1. Field

This invention relates to a display system for display of merchandise, as an item of decor for home or office, or as a simulated holiday tree or decoration.

2. State of the Art

Heretofore, display devices to provide versatility have involved interchangeable panels for releasable attachment to frames that serve as support structures. Such have however, generally been heavy and cumbersome and have had a limited potential for assembly into different shapes. An example of such a display device is shown in a U.S. Pat. by Wilkins, No. 3,756,421. Even where such a system has provided for rearrangement of panels into a number of configurations and where like the present invention, those panels have included perforated surfaces, such as are shown in U.S. Pats. by Ostring No. 3,756,422; by Bleed No. 3,917,072; and by Herzog No. 3,865,249 none have provided, for an arrangement of interconnected panels alone, for a freestanding structure as does the present invention. Nor have any provided a connection arrangement therefor for joining in edge to edge arrangement panels into into freestanding cone, star shaped, or drum configurations.

Additional to the assembly of the identical display panels of the present invention as a display system, such assembled structure can also be modified to function as a decor piece or as an artificial holiday tree or an item of decoration. Unlike such earlier arrangements of artificial Christmas trees, the present invention does not involve any center support. Such facilitates transport and storage as well as assembly over such earlier arrangements that have uniformly required support posts or stands. Examples of such earlier artificial or simulated Christmas trees are shown in U.S. Pats. by: Dieperink-Langereis, No. 1,577,207; Gutherie, No. 2,188,081; Hazelton, No. 2,447,856, by Szulewski, No. 4,057,665; and Eichenauer, No. 4,315,376.

SUMMARY OF THE INVENTION

It is, therefore, the general object of the present invention to provide a display system that utilizes identical triangular shaped, perforated panels and includes hardware for connecting the panels in edge to edge configuration for forming a number of freestanding shapes that will each function as a display system, item of decor, or holiday decoration.

An additional object of the present invention in a display system is to provide hardware items for use with assembled structure as hangers, for receiving lines, or string thereover for supporting ornaments, simulated foilage, or the like.

It is an additional object of the present invention in a display system to provide, as a basic component, a triangular shaped perforated panel that is inexpensive to produce, and can be easily and efficiently assembled into a freestanding structure for serving a number of functions.

In accordance with the above objects, the present invention in a display system includes a number of identical, triangular shaped, panels, each having like spaced apart perforations formed therein and includes hardware for joining the panels in edge to edge configuration. By arranging such uniform, triangular shaped panels in edge to edge configuration with apex contacting apex and base contacting base, where the panels are angled one to the other such as to form a circle, a cone shaped, freestanding display can be formed. Whereas, by edge to edge coupling of the panels, with apex contacting apex and base contacting base, and the panels serpentine from one another each at more than ninety degrees (90°) and less than one hundred eighty degrees (180°) from the preceeding and suceeding panel, a star configuration can be formed. Then, by alternating the edge to edge arrangement to base contacting apex and apex contacting base, where they are angled one to the other such as to form a circle, a freestanding drum can be constructed.

The invention further includes appropriate hardware items therewith to rigidly join or hinge connect the panels together, or as hangers. As for example, the invention provides as hardware items, eyes, hooks and double eye for installation into the panel perforations. Such eyes or double eyes can receive string threaded therethrough wherefrom paper, fabric, or the like can be hung. In practice, the cone shape configuration with spaced apart eye hangers arranged therearound with a string threaded throughthrough and with sections of paper or cloth hung thereover provides a simulated holiday or Christmas tree configuration that can include a cone shaped top piece for insertion in the cone top.

To closely connect the display panels together in edge to edge arrangement, clips are provided to span across the panel edges that are configured to fit to the contours of the erected shape. Also, internally contoured uniform or distinctly shaped rings of different internal cross-sections or diameters can be installed at different heights on the erected structure for providing horizontal support thereto and as flat horizontal surfaces whereon items can be displayed. Further, hinge hardware is included with the invention for providing a capability for opening and closing one of the triangular shaped panels around another panel, and channel tops and feet can be included for receiving a structure base and, as appropriate top fitted therein.

THE DRAWINGS

In the drawings, that illustrate that which is presently regarded as the best mode for carrying out the invention:

Figure 1:
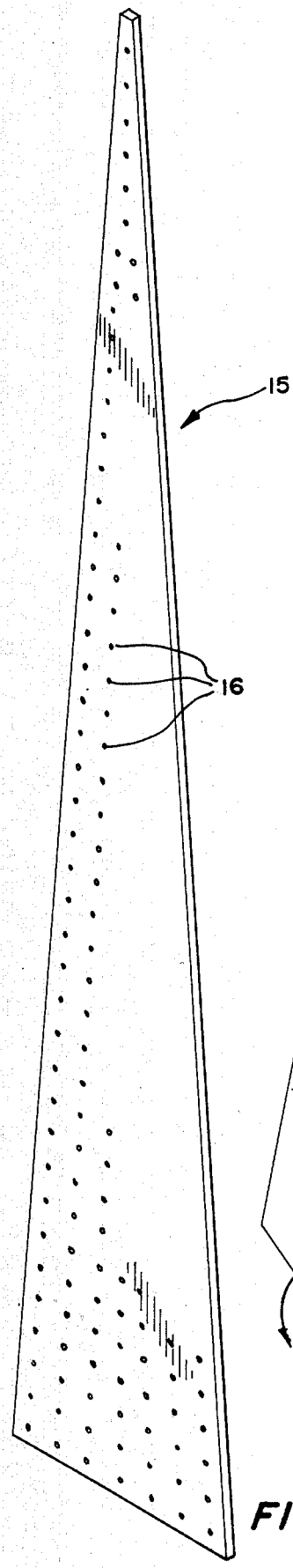
FIG. 1 is a profile perspective view of a preferred triangular shaped perforated panel of the present invention.
Figure 2:
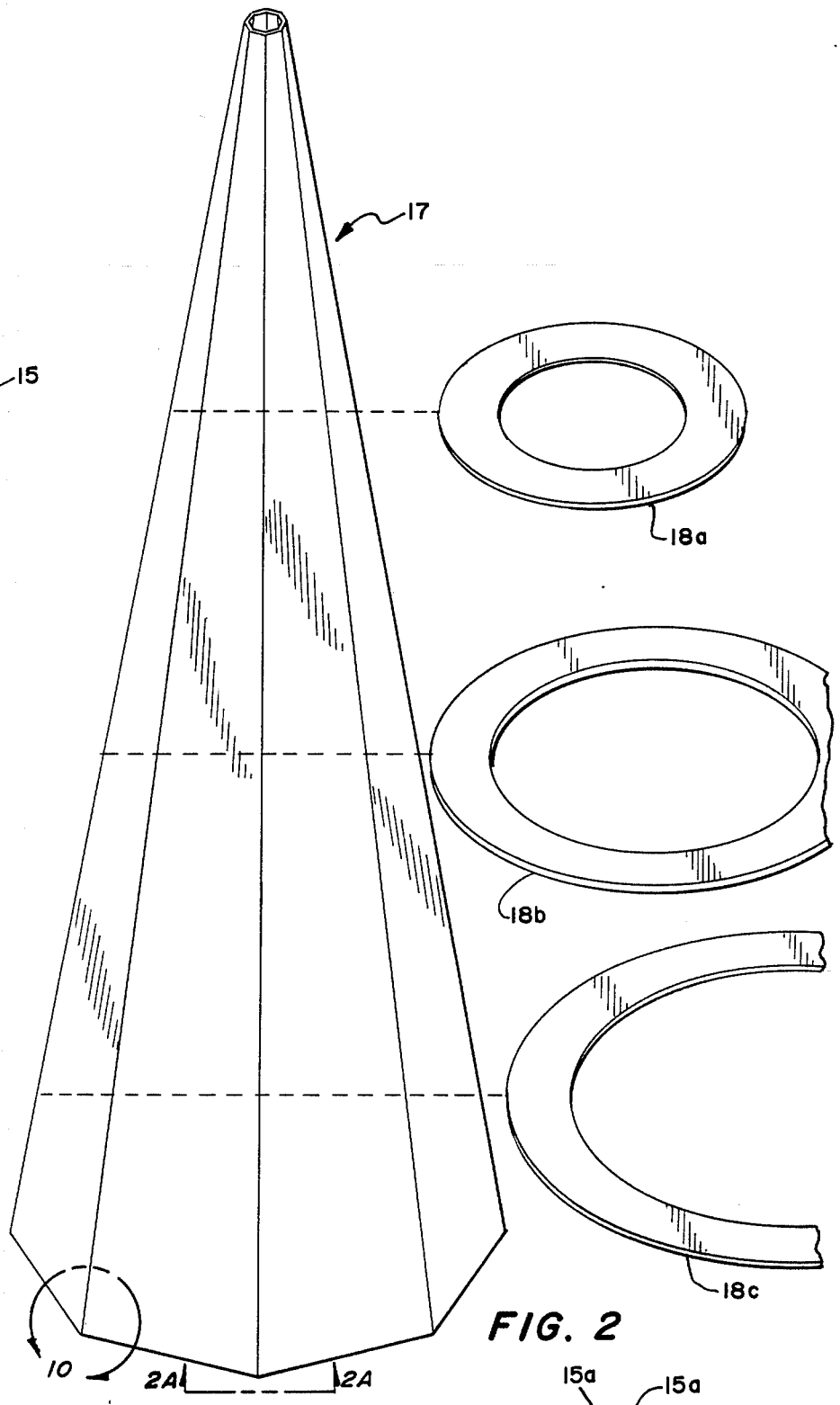
FIG. 2 is a profile sectional view of a freestanding cone constructed with triangular shaped panels of FIG. 1, showing a number of uniform rings each having a different diameter for installation down over said cone for providing lateral support thereacross.
Figure 3:
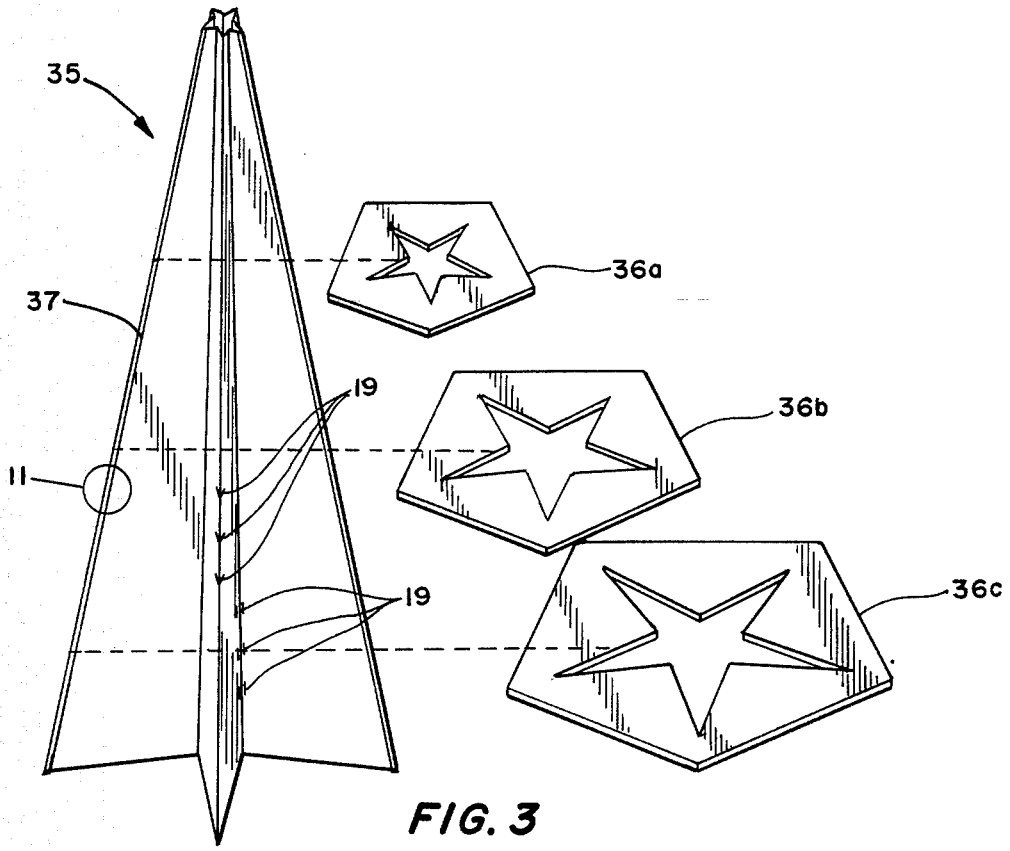
FIG. 3 is a perspective view of a star arrangement of triangular panels of FIG. 1 showing rings of different internal cross-section for arrangement down over said star for providing lateral support thereto.
Figure 6:
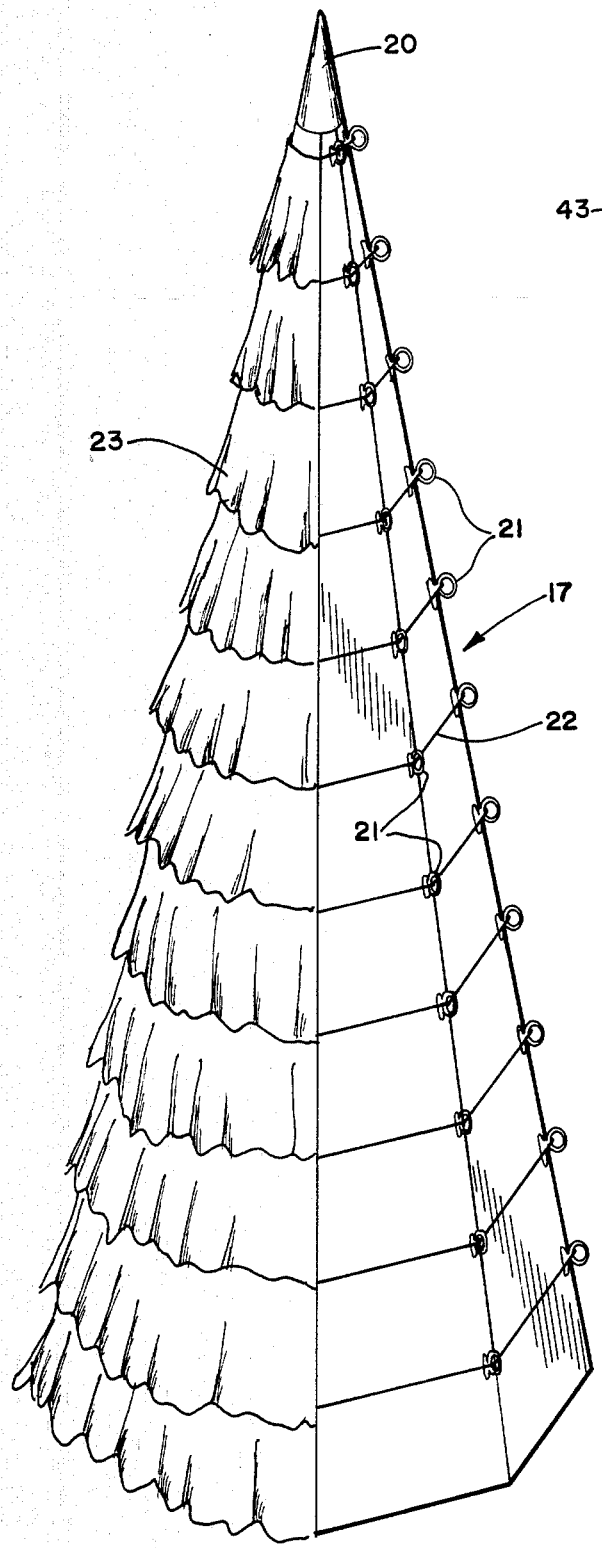
FIG. 6 is a profile perspective view of triangular panels of FIG. 1 arranged as a cone and includes a number of spaced apart, laterally aligned eye headed hardware items wherethrough are arranged strings circumscribing the cone with half of the cone shown as having had paper or cloth sections hung over the strings to simulate a holiday tree.
Figure 7:
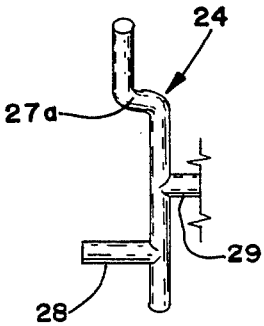
Figure 7A:
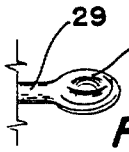
Figure 7B:
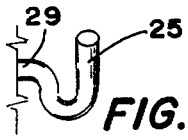
Figure 7C:
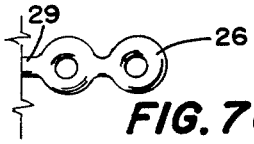
Figure 8:
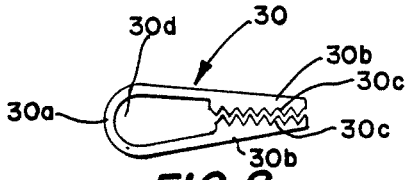
Figure 8A:
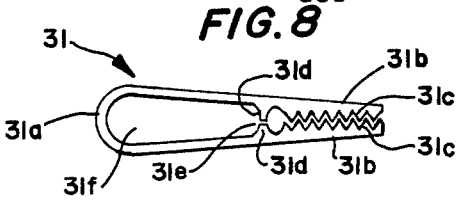
Figure 9:
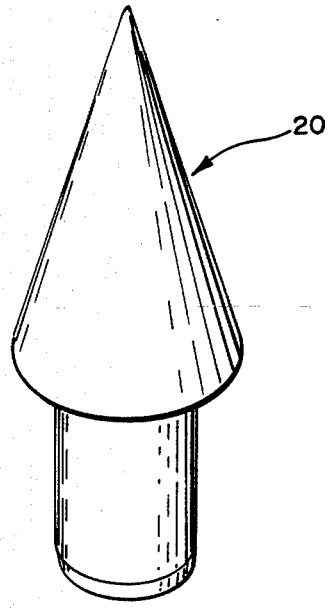
Figure 10:
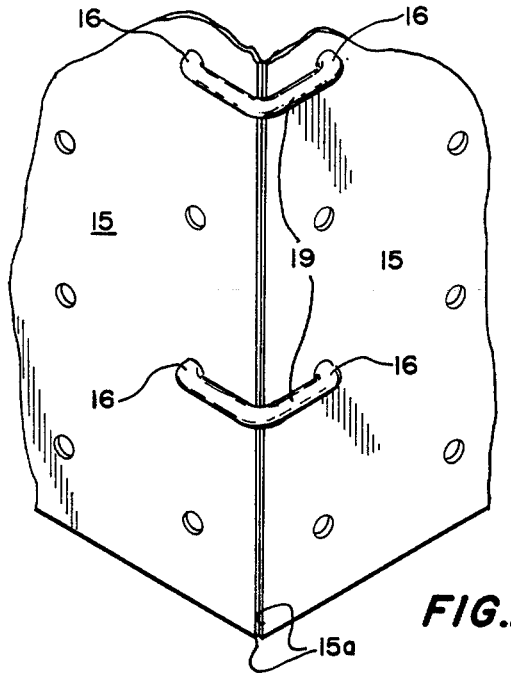
Figure 10A:
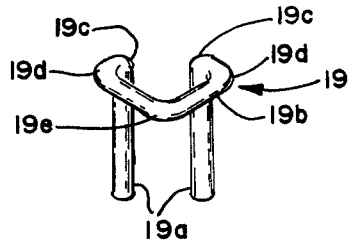
Figure 11:
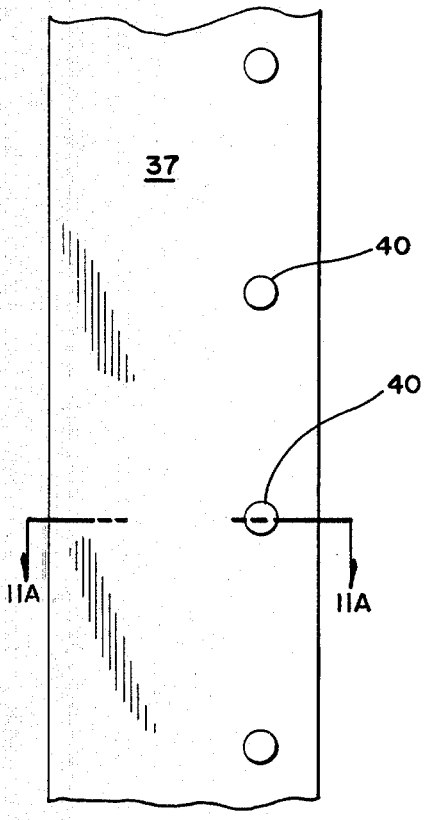
Figure 11A:
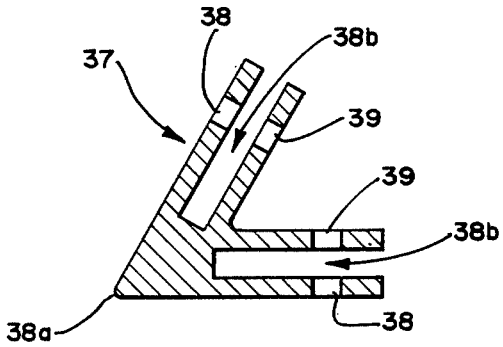

FIG. 7 is a preferred basic hardware item that consists of a body with a dogleg end for installation into one of the perforations in the triangular shaped panel of FIG. 1 and a post that projects at a normal angle from that body for installation in an adjacent perforation, and includes a connector post extending from a central point of the body that is shown broken for representing coupling to different hardware heads;

FIG. 7A shows an eye head for coupling to the post of the hardware item of FIG. 7;

FIG. 7B shows a hook head for coupling to the post of the hardware item of FIG. 7;

FIG. 7C shows a double eye head for coupling to the post of the hardware item of FIG. 7;

FIG. 8 shows a clip for inclusion over the strings of FIG. 6 for hanging sections of paper or cloth therefrom;

FIG. 8A shows, as another clip embodiment, an alligator clip for use like that of FIG. 8;

FIG. 9 shows a profile prospective view of a cone shaped top ornament for arrangement with the cone structure of FIG. 2 or FIG. 6;

FIG. 10 shows a sectional view taken within line 10—10 of FIG. 1 showing a device for maintaining edge to edge coupling of panels as a bent U-shaped hardware item;

FIG. 10A shows the bent U-shaped edge clip of FIG. 10 removed from the joined panels;

FIG. 11 shows a side elevation view of a section of an edge strip of FIG. 3 that has been removed therefrom; and FIG. 11A is a top plan sectional view of the edge strip of FIG. 11 taken along the lines 11A—11A.

DETAILED DESCRIPTION

Figure 2A:
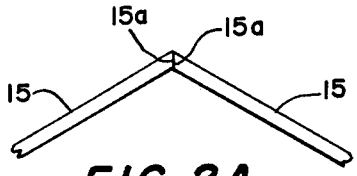
FIG. 2A is a sectional view taken along the line 2A—2A of FIG. 2 showing an edge to edge alignment of butting edges of two of the triangular shaped panels that make up the cone of FIG. 2.

Referring now to the drawings:

Shown in FIG. 1, is a triangular shaped, perforated display panel 15 of the present invention hereinafter referred to as display panel. The display panel includes equi-distantly spaced holes or perforations 16 formed therein for accommodating installed hardware items as will be discussed hereinbelow. Each display panel 15 as shown in FIG. 2A preferably includes along both vertical sides, angled edges 15*a* for close coupling together when formed into a freestanding structure. Display panels 15 are preferably finished on both faces such that each can be turned over or reversed for assembly together, as will be described herein. The angled edges 15*a* are such that they will conform, as shown as FIG. 2A, in close fitting engagement to provide a sharp outer edge when so arranged together.

Figure 4:
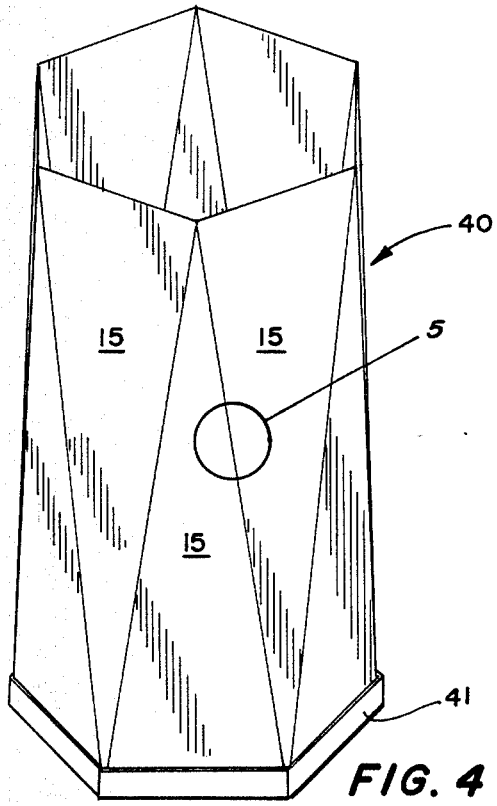
FIG. 4 is a drum arrangement of triangular shaped panels of FIG. 1.

By appropriate arrangement of display panels 15 in edge to edge configuration, a freestanding cone 17, shown in FIG. 2, a star 35, shown in FIG. 3, or a drum 40 shown in FIG. 4, can be constructed. Each configuration provides a structure that is self supporting and can be used for displaying items as by hanging such items from hangers installed in the display panel perforations, or by positioning of rings or like flat disks therearound. FIG. 2 shows rings 18*a*, 18*b* and 18*c* aligned with lateral sections across cone 17, shown in broken lines, which rings are shown to be uniform and are open across their centers to fit down and over the cone to the broken line sections. So arranged, each ring has different internal diameter of opening to provide stepped horizontal surfaces whereon items can be placed for display, as in a mercantile situation and, of course, any outer shape such as a heart, petals, or the like, could be substituted for the uniform ring within the scope of this disclosure.

FIG. 10 shows portions of two display panels 15 maintained in close engagement along their respective angled edges 15*a* by edge clips 19. Each edge clip as shown in FIG. 10A, is preferably formed from a section of wire of a diameter to fit snugly into a perforation 16. Each clip is contoured to closely fit around the junction of the butting display panels and appears as a yoke having straight parallel legs 19*a*, with essentially, a U-shaped web 19*b* that is bent at a right angle 19*c* from each leg. The web 19*b* is also bent at 19*d* and apex 19*e* to conform to the butting panel's surfaces. So arranged, the ends of legs 19*a* can be installed in edge holes 16 of each of each butting display panel, the legs turned downwardly along the inner surfaces, traveling to where the ends of the U-shaped web, below bends 19*d*, fit into display panel holes 16. The inner surface of U-shaped web will come to rest against the butting display panel surfaces, in contact therewith, as illustrated in FIG. 2. A number of display panels are so connected together, through a full circle the connected panels providing sole support to such an assembled cone structure.

Shown in FIG. 9, is an ornament 20 for fitting into the apex of cone 17, of FIG. 2, continuing the line of the cone surface to a sharp point. Preferably, for ease of manufacturing and assembly, the display panels 15 as shown in FIG. 1 are each cut across the apex thereof providing a flat surface that ornament 20 will cover. FIG. 6 illustrates an inclusion of ornament 20 with the cone struture of FIG. 1 arranged as an item of decor such as a holiday or Christmas tree. To so arrange the cone, a number of eye headed hardware items 21 are each fitted into the spaced perforations 16, in vertical and horizontal rows. The vertical rows descend along display panel edges 15*a* to receive a string 22, or the like, threaded therethrough circumscribing the cone, forming descending planes. The string, in turn, receives sections of paper or cloth 23, or the like, draped thereover or hung thereon to provide a tree appearance as illustrated. So arranged, with the cone including the top ornament 20, and draped as shown in FIG. 6, the arrangement of the assembled cone 17 can be used as an attractive decorator piece and to simulate a holiday or Christmas tree.

FIG. 7 shows a preferred connector hardware base 24 whereto hardware heads are secured such as the eye 21, discussed hereinabove and shown in FIG. 7A; a hook 25 that is shown in FIG. 7B; or a double ring 26 that is shown in FIG. 7C. FIGS. 7A, 7B, and 7C therefore, show some of the hardware heads that can be included with the hardware base that, as shown in FIG. 7 includes a wire body 27. The body 27 has a dogleg bend 27*a* formed therein proximate to one end and includes an outwardly projecting post 28 that extends at a normal angle from the body proximate to the other end thereof, the bend 27*a* and post spaced apart the distance between performations 16 in display panel 15. A connector post 29 is secured to extend at a normal angle outwardly from approximately a mid-point of body 27, opposite to post 28. A cut-off portion of which connector post 29 is shown also in FIGS. 7A, 7B, and 7C secured to a hardware head shown therein. So arranged, in operation, to secure a hardware item to a display panel, the dogleg end of the body 27 is installed in one of the perforations 16 until contact is made with that perforation and the dogleg bend 27*a* whereupon the post 28 is fitted into an aligned adjacent perforation 16 and the body 27 pushed into contact with the display panel surface across the perforations 16. So arranged, the hardware items shown in FIGS. 7A, 7B, and 7C are secured to extend outwardly from the display panel for receiving items thereover such as the string 22, shown in FIG. 6, and, as for example, the hook 25 can be used to suspend items therefrom.

For conveniently attaching sections of the paper or cloth 23 to strings 22, other than by draping them over the strings, jaw clips 30 and 31 shown, respectively, in FIGS. 8 and 8A are provided. Jaw clip 30 involves a single section bent at 30*a* into a U-shape with equal legs 30*b*. The opposite surfaces of legs 30*b* include serrations or teeth 30*c* therein. So arranged, the clip can be fitted over string 22, the string pass between teeth 30*c* and comes to rest in open area 30*d* between the legs. Thereafter, the legs 30*b* can be spread apart to pass a portion of the paper or fabric 23 between the teeth surfaces 30*c*, clamping thereto. Jaw clip 31, shown in FIG. 8A is similar to clip 30, in that it is also formed from a single section that is bent into a U at 31*a* forming equal legs 31*b* that also include serrations or teeth 31*c* formed therein. Additionally, the clip 31 is arranged to function as an alligator clip where by squeezing together legs 30*b* back from opposing piers 31*d*, that are arranged on approximately mid-points of legs 31*b*, it will function as an alligator clip, the teeth 31*c* moved apart. Thereby, when a person squeezes the clip legs together, proximate to bend 31*a*, the legs pivot around piers 31*d*, functioning as jaws that open to allow for portions of the sheets of paper or cloth 23 to be filled between teeth 31*c*. Like clip 30, clip 31 is preferably hung on string 22, by moving legs 31*b* apart, passing string 22 therebetween and through opening 31*e* between piers 31*d* and into open area 31*f* within the clip.

FIGS. 2 and 6, as set out above, illustrate a utilization of a number of display panels 15 of FIG. 1 for constructing a freestanding cone 17, for use as a display stand, as a simulated holiday or Christmas tree, or like item decor item. Additionally, the individual display panels can be arranged to extend as points of a star at less than one hundred eighty degree (180°) angles from one another, by connecting the display panel 15 is an edge to edge configuration where the panels are aligned front to back and back to front, with the sloping surfaces 15*a* of each panel either butted together or arranged in legs or a V-shaped edge bracket, as discussed hereinbelow. This arrangement is shown as the freestanding star 35 of FIG. 3. Similar to the described arrangement rings 18*a*, 18*b*, and 18*c* with cone 17 of FIG. 2, the star 35 will accommodate flat disk rings 36*a*, 36*b*, and 36*c* dropped thereover to occupy the positions shown by broken lines thereacross. Shown in FIG. 3, center star portions of each ring 36*a*, 36*b*, and 36*c* have been removed to closely fit to the star surface to provide continuous horizontal surfaces therearound for supporting display items resting thereon and, of course, the outer shape can be as shown or any desired shape such as a heart, petals or the like.

For coupling display panel butting angled edges 15*a* together, a hardware item, like that shown in FIG. 10A as edge coupler 19, could be installed as shown in FIG. 10 except that such hardware item, at bend 19*e*, would be appropriately bent inwardly or outwardly to the relative angle of adjacent display panels for holding the structure together. Alternatively, a V-shaped edge bracket 37 that is shown in FIG. 11 removed from a point of the star of FIG. 3, can be arranged to receive and maintain the display panel edges fitted therein. The edge bracket, shown in the top sectional view of FIG. 11A includes legs 38 that meet at an apex 38*a*, and angle outwardly from one another at the angle of the display panels. Each edge bracket includes recesses 38*b* formed therein to receive a display panel edge and includes lateral holes 39 formed therethrough. With display panel edges so installed, edge display panel perforations 16 will align with edge bracket holes 39 for receiving a pin, not shown, to maintain the edge bracket thereto, which pin could be a post 28 of hardware base 27.

Figure 4B:
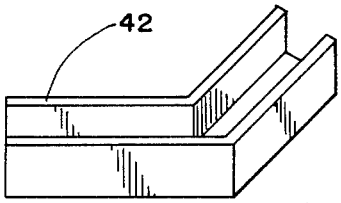
FIG. 4B is a section of a broken channel foot of FIG. 4.
Figure 4A:
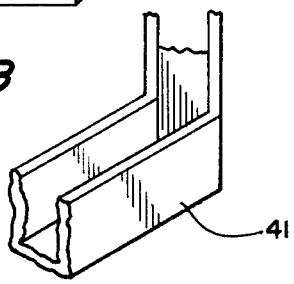
FIG. 4A is a broken away section of a portion of a continuous channel foot of the drum of FIG. 4.

FIG. 4 shows another arrangement of display panels 15 formed ed into drum 40. To form drum 40, each panel is reversed from the preceeding and succeeding panel, the panels contacting apex to, providing a close fitting of the angled edges. Thereby, edges 15*a* will contact one another as shown in FIG. 2A, the formed drum having equal diameter base and top ends as shown in FIG. 4. A channel bracket 41 or channel brackets 42, FIGS. 4A and 4B can be provided for receiving one or both drum ends therein. Shown in FIG. 4A, the channel bracket 41 can be continuous or, as shown in FIG. 4B, can be formed in channel sections 42 that are arranged end to end, each contacting another between the long based end of each triangular display panel 15. So arranged, the display panel of the invention can be arranged as a drum, the panels connected together as described above, and/or can include edge clips like the edge clips 19 already described herein, for holding the panel edges together or the like.

Figure 5:
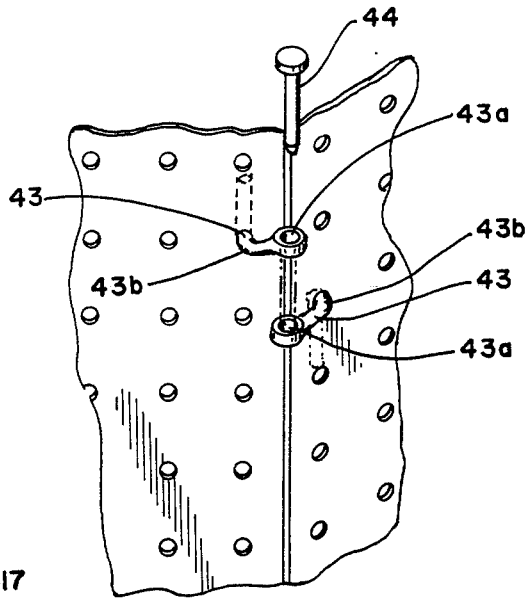
FIG. 5 is a broken away section of an edge to edge junction of two of the panels of the drum of FIG. 4 that are shown as coupled by a hinge arrangement with a pin shown aligned for installation therethrough, providing for a hinge coupling of the one panel to the other.

FIG. 5 shows a removed portion of FIG. 4, as including a hinge coupling of adjacent panels to provide access into the drum interior. Each preferred half hinge 43 consists of a pair of hardware items, each with a ring head 43*a* that is connected to anend of a wire section 43. The wire section is bent into a dogleg 43*b* at a normal angle thereto to fit into one of the perforations in the edge of a display panel. With the pair of hinge halves, each half spaced apart from the other and fitted into aligned adjacent perforation in butting display panels, a pin 44 is fitted through the center openings in each ring head 43*a* the pin spanning therebetween. Of course, a number of pairs of such hinges can be included for joining panel edges together and an appropriate stop arrangement, not shown, can be arranged on the butting triangle leg surfaces, as needed to prevent travel of a panel around the hinge coupling into the drawn interior. With channel brackes 41 or 42 provided for both the base and top surfaces, such stop would likely not be necessary through some lifting or prying of a channel bracket away from the pivoting display panel's base and apex ends would be required for pivoting the one panel around the other.

Hereinabove, the display panel 15 of the present invention has been shown as being suited for assembly into certain freestanding structures utilizing a number of different hardware items or channel coupling configurations, for holding these panels together. It should be understood, however, that the hardware items and the channel arrangement shown herein are preferred but that other like or similar items could be substituted therefor within the scope of this disclosure. Also, the flat disk rings shown in FIGS. 2 and 3 as fitted over the structures of cone 17 and star 35 could be modified from the disclosure or dispensed with entirely at the option of the person assembling the structure.

While a number of freestanding structures are formed from the edge to edge connection of the display panels of the present invention as shown and described, it should be understood that the present disclosure is not limited to these structures only and that other arrangements additional to those shown herein are possible without departing from subject matter coming from the scope of the following claims which claims I regard as my invention.

I claim:

1. A display system comprising a plurality of triangular shaped display panels, said display panels to fit together in edge to edge configuration, a number of said display panels so fitted together to enclose an area forming a freestanding structure, each display panel including uniformly spaced-apart perforations formed therein; and clip means for maintaining said display panels in edge to edge engagement, each clip means consisting of a clip formed from a straight section of rigid material of an appropriate diameter at the ends to fit within the panel perforations and is formed into a U-shape to have essentially parallel legs that extend from a web that is bent at a normal angle to said legs to rest against the surfaces of the joined display panels, said leg ends to fit in said perforations in each of the aligned panels, the clip means to extend across the junction of said abutting panels.

2. A display system as recited in claim 1, wherein the display panels are finished on both faces.

3. A display system as recited in claim 1 wherein the display panel edges are angled to closely fit together when maintained in edge to edge configuration.

4. A display system as recited in claim 1, further including a channel bracket means arranged to receive and support an end of the freestanding structure fitted therein.

5. A display system as recited in claim 4, wherein the channel bracket has a U-shape and is arranged as a continuous section.

6. A display system as recited in claim 4, wherein the channel bracket has a U-shape and is formed in sections for fitting together in end to end arrangement.

7. A display system as recited in claim 1, further including continuous ring means having a removed center portion of the shape of the free standing structure circumference at a select height thereon for travel over and down said structure to rest on said structure circumference and provide a flat surface for display of items thereon.

8. A display system as recited in claim 1, further including bent wire hardware means for installation in said display panel perforations, that includes a leg portion having a dogleg bend to fit within said panel perforation such that a head thereof extends outwardly from said display panel surface.

9. A display system as recited in claim 8, wherein the head is a ring.

10. A display system as recited in claim 8, wherein the head is a double ring.

11. A display system as recited in claim 9 or 10, further including with the hardware means fitted into spaced perforations so as to circumscribe the structure in parallel planes, threading and tying a line through said hardware means rings that are laterally aligned to receive sections of material hung therefrom.

12. A display system as recited in claim 11 further including clip means for arrangement over the continuous ring for receiving a section of material between jaws thereof.

13. A display system as recited in claim 8, further including a hinge means that includes a pair of rings formed in the ends of body sections that are bent for installation in panel perforations at edges thereof of edge to edge abutting display panels such that said rings align along and over said abutting display panel edges edge to receive a pin fitted therethrough.

14. A display system as recited in claim 8, further including a body with said head secured thereto and extending outwardly therefrom, which body is formed from a section of wire of a diameter to fit snugly into a display panel perforation, is bent into a dogleg at one end and includes a post secured to extend at a normal angle outwardly from said body, opposite to said head, which post and dogleg bend are spaced apart the distance between perforations in said display panel.

* * * * *